US008780146B2

(12) United States Patent
Huang et al.

(10) Patent No.: US 8,780,146 B2
(45) Date of Patent: Jul. 15, 2014

(54) DRIVING MEMBER AND DRIVING MEMBER ARRAY MODULE

(75) Inventors: Sung-Hui Huang, Hsinchu (TW); Wei-Chou Lan, Hsinchu (TW); San-Long Lin, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 520 days.

(21) Appl. No.: 12/869,130

(22) Filed: Aug. 26, 2010

(65) Prior Publication Data

US 2011/0187765 A1 Aug. 4, 2011

(30) Foreign Application Priority Data

Feb. 3, 2010 (TW) ..... 99103190 A

(51) Int. Cl.
*G09G 5/02* (2006.01)
*H01H 57/00* (2006.01)

(52) U.S. Cl.
USPC ..... 345/698; 200/181

(58) Field of Classification Search
USPC ..... 345/84–86, 108–111; 359/196
See application file for complete search history.

(56) References Cited

U.S. PATENT DOCUMENTS

| | | | | |
|---|---|---|---|---|
| 2007/0177247 | A1 | 8/2007 | Miles | |
| 2008/0130089 | A1* | 6/2008 | Miles | 359/290 |
| 2009/0002590 | A1* | 1/2009 | Kimura | 349/43 |
| 2009/0260961 | A1 | 10/2009 | Luce et al. | |

FOREIGN PATENT DOCUMENTS

| | | |
|---|---|---|
| CN | 1656643 | 8/2005 |
| CN | 1875446 | 12/2006 |
| CN | 101018734 A | 8/2007 |
| CN | 101501805 | 8/2009 |
| TW | 591716 | 6/2004 |
| TW | 593126 | 6/2004 |
| WO | 2005015595 | 2/2005 |

OTHER PUBLICATIONS

China Patent Office Action Jun. 5, 2013, China.
Taiwan Patent Office, Office Action, Oct. 11, 2013.

* cited by examiner

*Primary Examiner* — Kent Chang
*Assistant Examiner* — Scott Au
(74) *Attorney, Agent, or Firm* — WPAT, PC; Justin King

(57) ABSTRACT

An exemplary driving member and an exemplary array module formed by a plurality of the driving members are disclosed in the invention. The driving member includes a first suspending beam module, a second suspending beam module and a conductive suspending beam module. When a voltage is provided between the first suspending beam module and the second suspending beam module, or the first suspending beam module and the second suspending beam module are provided with two homopolar voltages, when the electric field force is larger than the deforming force threshold of the first suspending beam, the first suspending beam moves to contact with the conductive suspending beam module, so that the first suspending beam has a voltage same with the conductive suspending beam module. When the electric field force is smaller than the deforming force threshold of the first suspending beam, the first suspending beam module rebounds to an original state.

18 Claims, 10 Drawing Sheets

DRIVING MEMBER AND DRIVING MEMBER ARRAY MODULE

BACKGROUND

1. Technical Field

The present invention generally relates to driving members and, particularly to a novel driving member, a driving member array module and a manufacturing method of the driving member.

2. Description of the Related Art

In prior art, the manufacture material of a thin film transistor (TFT) primarily includes inorganic materials such as silicon (Si) and germanium (Ge). Comparing the inorganic materials with organic semiconductors, a carrier mobility of the inorganic materials is higher than the carrier mobility of the organic semiconductors for three magnitudes. Thus, most of active display devices adopt inorganic semiconductor especially amorphous silicon (a-Si) TFT as a driving member thereof. Due to a-Si TFT has advantages of that it has function of controlling the delivery of pixel signals and can be manufactured in low temperature, the driving member used with the a-Si TFT becomes a mainstream in the market.

However, for matching a display media with more fast response and a more complex signal processing, the driving members in next generation are required with high current switch ratio, high carrier mobility and power saving. At present, there are some approaches for improving characteristics of the driving members, for example, using compound semiconductors with different doping densities, or polycrystalline silicon TFTs manufactured in a low temperature process, however, due to the drawbacks caused by cost of equipment and yield, the driving members still cannot meet above requirements. Thus, a novel driving member is proposed in the present invention. The driving member is a driving switch manufactured based on micro-electro-mechanical theory. The driving member can resolve some disadvantages of the a-Si TFT, and furthermore can improve some characteristics of the display devices. Otherwise, the manufacture process is simplified and the yield is improved.

BRIEF SUMMARY

Accordingly, the present invention is directed to a driving member, which can solve above problems.

The present invention further is directed to a driving member array module formed by a plurality of above driving members.

In an embodiment of the present invention, the driving member includes a first suspending beam module, a second suspending beam module and a conductive suspending beam module. When a voltage is provided between the first suspending beam module and the second suspending beam module, or the first suspending beam module and the second suspending beam module are provided with two homopolar voltages, and thereby when an electric field force formed between the first suspending beam module and the second suspending beam module is larger than a deforming force threshold of the first suspending beam, the first suspending beam module electrically contacts with the conductive suspending beam module, so that the conductive suspending beam has a voltage same with the first suspending beam module. Thereafter when the electric field force is smaller than the deforming force threshold of the first suspending beam, the first suspending beam module rebounds to an original shape thereof.

In an embodiment of the present invention, the first suspending beam module and the second suspending beam module are made of amorphous silicon, or any conductive metal or alloy.

In an embodiment of the present invention, the first suspending beam module includes a first suspending beam and a first suspending beam holding terminal, the first suspending beam holding terminal is arranged at one end of the first suspending beam, and the first suspending beam holding terminal is wider than the first suspending beam.

In an embodiment of the present invention, the conductive suspending beam module includes a conductive suspending beam and a conductive suspending beam holding terminal, the conductive suspending beam is extended from the conductive suspending beam holding terminal, and one end of the conductive suspending beam is bended towards the first suspending beam.

In an embodiment of the present invention, the second suspending beam module includes a second suspending beam and two second suspending beam holding terminals arranged at both ends of the second suspending beam, the second suspending beam holding terminals each is wider than the second suspending beam.

In an embodiment of the present invention, the first suspending beam, the conductive suspending beam and the second suspending beam are all suspended in their original states.

In an embodiment of the present invention, the conductive suspending beam module is arranged between the first suspending beam module and the second suspending beam module, when the voltage is provided between the first suspending bean and the second suspending beam, the first suspending beam moves towards the second suspending beam to electrically contact with the second suspending beam.

In an embodiment of the present invention, the first suspending beam module is arranged between the conductive suspending beam module and the second suspending beam module, when the first suspending beam are being provided with the two homopolar voltages, the first suspending beam moves away from the second suspending beam to electrically contact with the conductive suspending beam.

In another embodiment of the present invention, a driving member includes a first suspending beam module, a second suspending beam module, and a conductive suspending beam module arranged between the first and second suspending beam modules. When a voltage applied between the first suspending beam module and the second suspending beam module is smaller than a predetermined value, the first suspending beam module is not electrically contacted with the conductive suspending beam module; when the voltage achieves the predetermined value, the first suspending beam module is electrically contacted with the conductive suspending beam module, so that the conductive suspending beam module has a voltage same with the first suspending beam module.

In an embodiment of the present invention, the first suspending beam module and the second suspending beam module are made of amorphous silicon, or any conductive metal or alloy.

In an embodiment of the present invention, the first suspending beam module includes a first suspending beam and a first suspending beam holding terminal, the first suspending beam holding terminal is arranged at one end of the first suspending beam, and the first suspending beam holding terminal is wider than the first suspending beam.

In an embodiment of the present invention, the conductive suspending beam module includes a conductive suspending beam and a conductive suspending beam holding terminal, the conductive suspending beam is extended from the conductive suspending beam holding terminal, and one end of the conductive suspending beam is folded towards the first suspending beam.

In an embodiment of the present invention, the second suspending beam module includes a second suspending beam and two second suspending beam holding terminals arranged at both ends of the second suspending beam, the second suspending beam holding terminals each is wider than the second suspending beam.

In an embodiment of the present invention, the first suspending beam, the conductive suspending beam and the second suspending beam are all hung in their original states.

In a third embodiment of the present invention, a driving member array module includes a substrate, a plurality of driving members arranged on the substrate, at least a scanning line group and at least a signaling line group. The at least a scanning line group and the at least a signaling line group are electronically connected to the plurality of driving members as the same as the above.

In an embodiment of the present invention, the substrate is a glass substrate or another insulating substrate.

In an embodiment of the present invention, each of the at least a scanning line group includes a plurality of scanning lines respectively connected to the second suspending beam modules of a plurality of driving members in a same row.

In an embodiment of the present invention, each of the at least a signaling line group includes a plurality of signaling lines respectively connected to the first suspending beam modules of a plurality of driving members in a same column.

In an embodiment of the present invention, when the scanning line and the signaling line connected to any one of the driving members are conducted, a voltage is formed between the first suspending beam and the second suspending beam of the driving member, or the first suspending beam and the second suspending beam can be provided with two homopolar voltages.

In a forth embodiment of the present invention, a driving member array structure includes a substrate, a first metal layer, a first insulating layer, a second metal layer, a second insulating layer, a sacrifice layer and a suspending beam sequentially formed in that order.

In an embodiment of the present invention, a contacting hole is defined in the sacrifice layer and the second insulating layer, the suspending beam is conducted with the second metal layer after patterning through the contacting hole.

In an embodiment of the present invention, the first metal layer is formed on the substrate, and thereafter a first metal layer pattern is formed with a photolithography etch process.

In an embodiment of the present invention, the first metal layer is made of any conductive metal or alloy.

In an embodiment of the present invention, the first insulating layer and the second insulating layer are made of SiO2 or SiNx.

In an embodiment of the present invention, the second metal layer is formed on the first insulating layer, and thereafter a second metal layer pattern is formed with a photolithography etch process.

In an embodiment of the present invention, a conductive transparent layer is formed on the second insulating layer, and thereafter a conductive transparent layer pattern is formed with a photolithography etch process.

In an embodiment of the present invention, the second metal layer is made of any conductive metal or alloy.

In an embodiment of the present invention, the sacrifice layer is made of molybdenum or polymer.

In an embodiment of the present invention, the suspending beam is made of amorphous silicon, or any conductive metal or alloy.

The driving member and the driving member array module provided in the present invention integrate the design of active driving member with the theory of micro-electro-mechanical system (MEMS). Due to it is unnecessary to use silicon as semiconductor layer, thus, the driving member and the driving member array module have many advantages over the a-Si TFT, such as high carrier mobility supporting a faster processing system e.g., for image processing, and without the issue of leakage current that can provide a higher current switch ratio.

The driving member and the driving member array module adopt a low temperature manufacture technology, so as to have advantages of avoiding problems in manufacture, simplifying the process, reducing the cost, and improving the production capacity. With the advantages, the driving member in present invention has more competitive strength to be the driving member of next generation.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present invention provides a novel driving member for liquid crystal display (LCD) that integrates a design of active driving member with a theory of micro-electro-mechanical system (MEMS). The design of active driving member primarily is for controlling an action of a pixel in a corresponding position, and the use of MEMS is primarily for integration of mechanical electronics such as switch valve, brake and motor.

Figure 1:
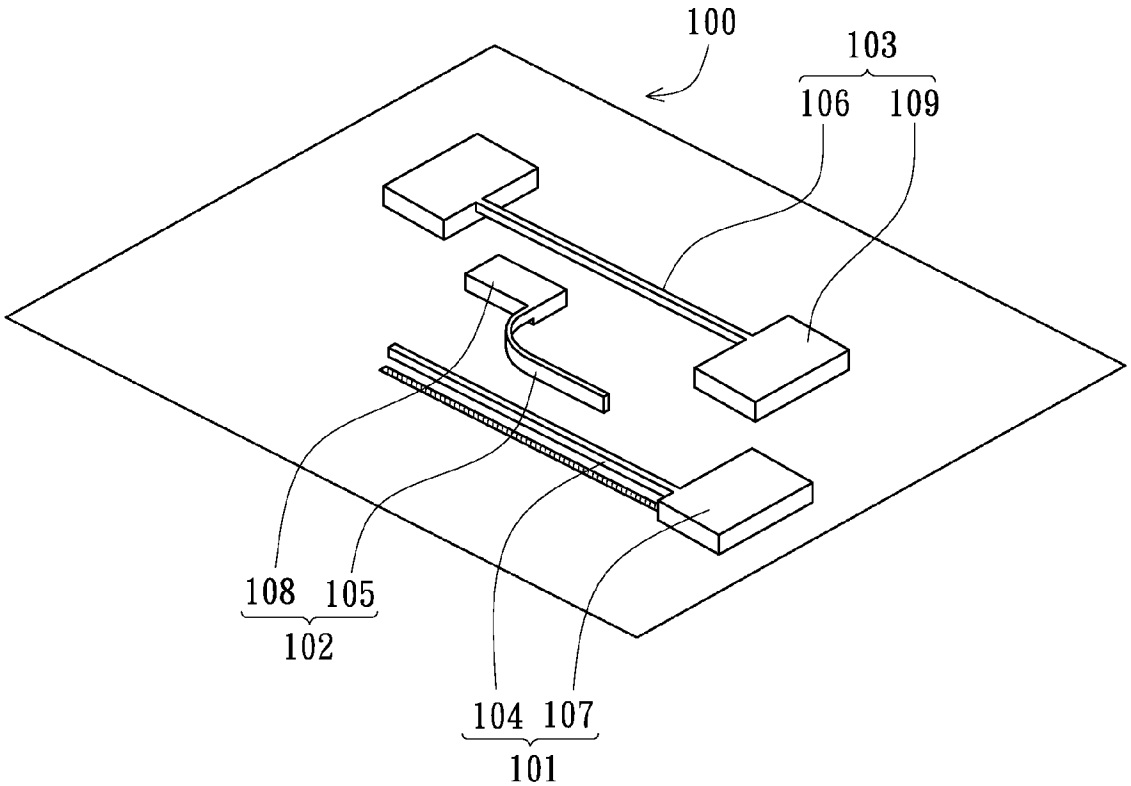
FIG. 1 shows a perspective view of a driving member in accordance with a first embodiment of the present invention.

FIG. 1 shows a perspective view of a driving member 100 in the present invention. The driving member 100 includes a first suspending beam module 101, a conductive suspending beam module 102, and a second suspending beam module 103. The first suspending beam module 101 can be made of a-Si, or any conductive metal or alloy. The first suspending beam module 101 includes a first suspending beam 104 and a first suspending beam holding terminal 107. The first suspending beam holding terminal 107 is arranged at one end of the first suspending beam 104. The first suspending beam holding terminal 107 is wider than the first suspending beam 104.

The conductive suspending beam module 102 is arranged between the first suspending beam module 101 and a second suspending beam module 103. The conductive suspending beam module 102 can be made of any conductive metal or alloy. The conductive suspending beam module 102 includes a conductive suspending beam 105 and a conductive suspending beam holding terminal 108. The conductive suspending beam 105 is extended from the conductive suspending beam holding terminal 108, and one end of the conductive suspending beam 105 is bended towards the first suspending beam 104.

The second suspending beam module 103 can be made of a-Si, or any conductor metal or alloy. The second suspending beam module 103 includes a second suspending beam 106 and two second suspending beam holding terminals 109 arranged at both ends of the second suspending beam 106. Each of the second suspending beam holding terminals 109 is wider than the second suspending beam 106.

Figure 2A:
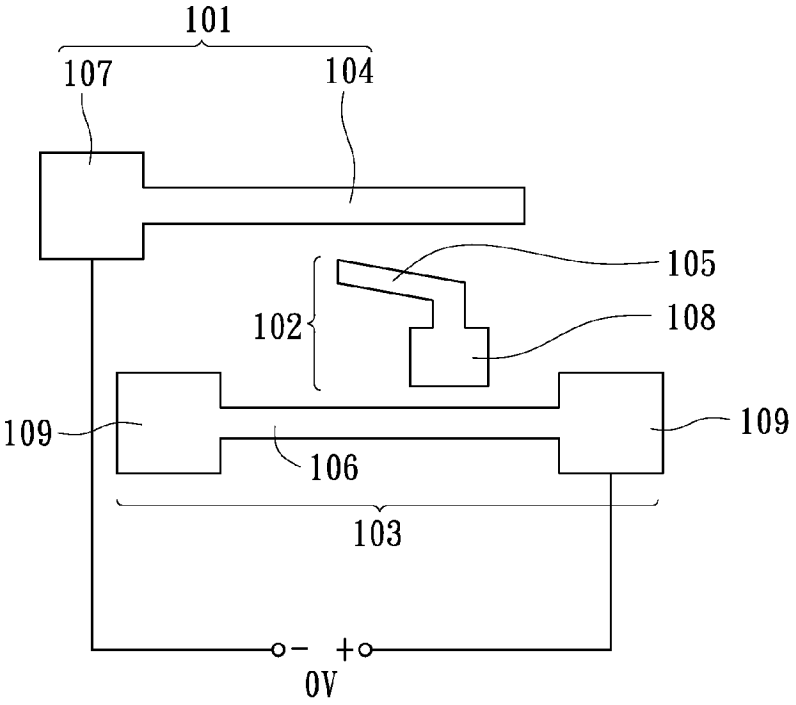
FIG. 2A shows a top view of the driving member shown in FIG. 1 in an original state.

FIG. 2A shows a top view of the driving member 100 in an original state in accordance with a first embodiment of the present invention. In the original state, the first suspending beam 104, the conductive suspending beam 105 and the second suspending beam 106 are all in suspending states. In use, a voltage can be provided between the first suspending beam 104 and the second suspending beam 106, so that the first suspending beam 104 moves to electrically contact with the conductive suspending beam 105.

Figure 2B:
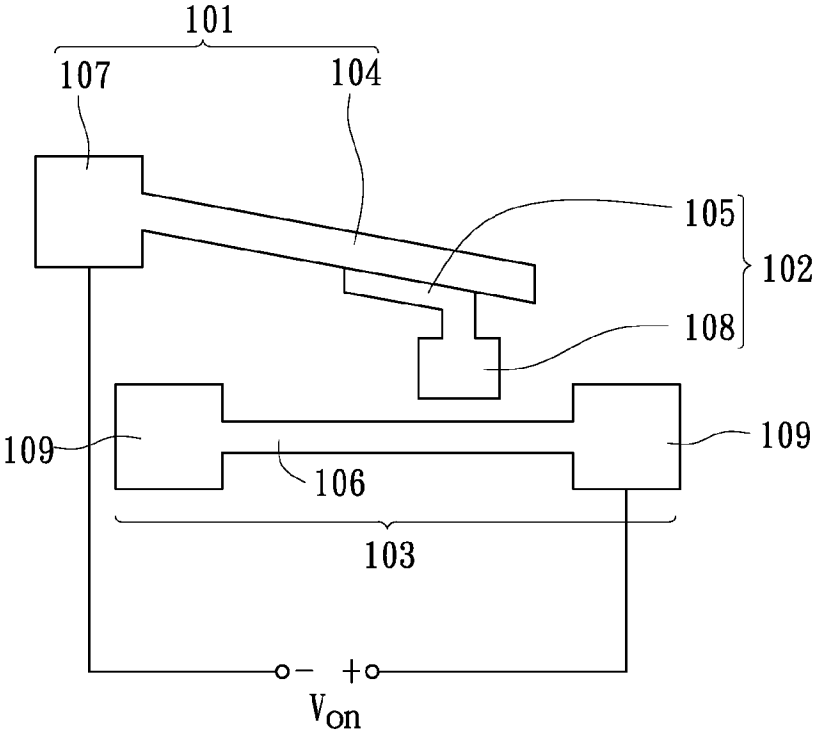
FIG. 2B shows a top view of the driving member shown in FIG. 1 provided with a voltage.

FIG. 2B shows a top view of the driving member 100 shown in FIG. 2A provided with a voltage. When the voltage is provided between the first suspending beam 104 and the second suspending beam 106, electrical signals are transmitted from the first suspending beam holding terminal 107 and the second suspending beam holding terminals 109 respectively to the first suspending beam 104 and the second suspending beam 106. Due to an electric field attractive force formed between the first suspending beam 104 and the second suspending beam 106 is larger than a deforming force threshold of the first suspending beam 104, the first suspending beam 104 moves towards the second suspending beam 106 to electrically contacted with the conductive suspending beam 105, so that neighboring conductive suspending beam 105 and first suspending beam 104 are short circuited, and the neighboring conductive suspending beam 105 has a voltage same with the first suspending beam 104. When the electric field force formed by the voltage between the first suspending beam 104 and the second suspending beam 106 thereafter is smaller than the deforming force threshold of the first suspending beam 104, the first suspending beam module 101 has an inherent pulling stress force to make the first suspending beam 104 rebound to the original state, thus, constituting an MEMS switch member.

In other words, when the electric field force of the voltage between the first suspending beam 104 and the second suspending beam 106 is smaller than a predetermined value, the first suspending beam module 101 is not electrically contacted with the conductive suspending beam module 102. When the electric field force achieves the predetermined value, the first suspending beam module 101 is electrically contacted with the conductive suspending beam module 102, so that the conductive suspending beam module 102 has a voltage same with the first suspending beam module 101.

Figure 3A:
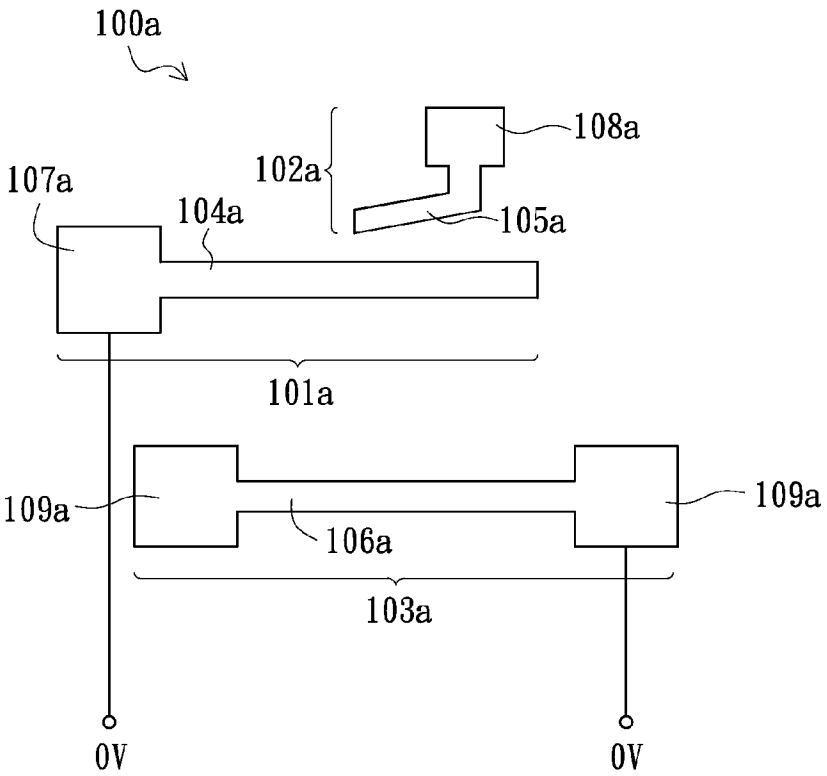
FIG. 3A shows a top view of a driving member in an original state in accordance with a second embodiment of the present invention.

Referring to FIG. 3A, FIG. 3A shows a top view of a driving member 100*a* in an original state in accordance with another embodiment of the present invention. A first suspending beam module 101*a* is arranged between a conductive suspending beam module 102*a* and a second suspending beam module 103*a*. In the original state, the first suspending beam 104*a*, the conductive suspending beam 105*a* and the second suspending beam 106*a* are all hung. In use, the first suspending beam 104*a* and the second suspending beam 106*a* can be provided with two homopolar voltages, due to an electric field repulsion force between the first suspending beam 104*a* and the second suspending beam 106*a*, the first suspending beam 104*a* moves to electrically contact with the conductive suspending beam 105*a*.

Figure 3B:
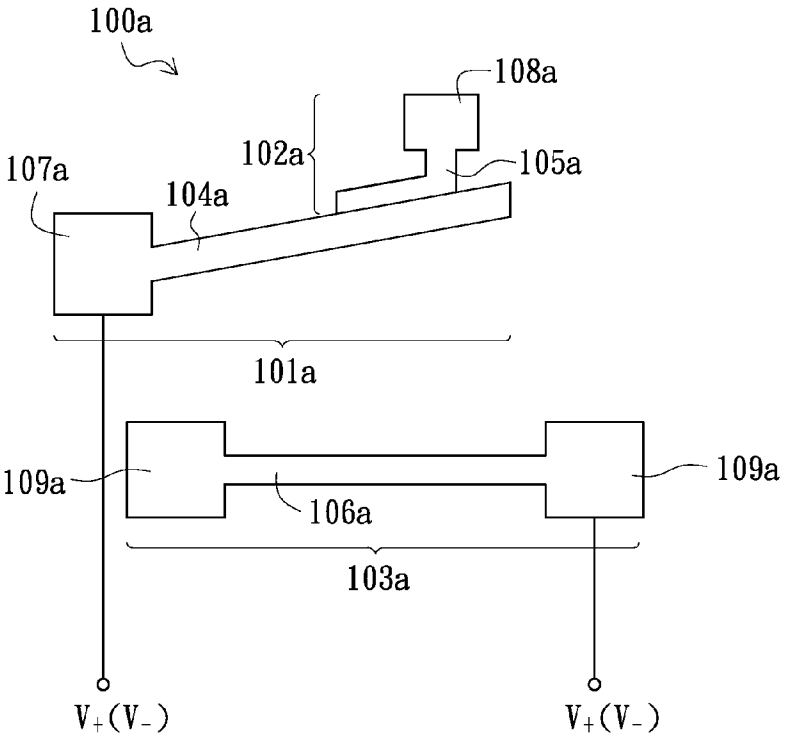
FIG. 3B shows a top view of the driving member shown in FIG. 3A provided with homopolar voltages.

Referring to FIG. 3B, FIG. 3B shows a top view of the driving member 100*a* provided with homopolar voltages. When both the first suspending beam 104*a* and the second suspending beam 106*a* are provided with a same positive voltage V+ or a same negative voltage V−, due to the electric field repulsion force is larger than the deforming force threshold of the first suspending beam 104*a*, the first suspending beam 104*a* moves away from the second suspending beam 106*a* to electrically contact with the conductive suspending beam 105*a*, so that neighboring conductive suspending beam 105*a* and first suspending beam 104*a* are short circuited, and the neighboring conductive suspending beam 105*a* has a voltage same with the first suspending beam 104*a*. When the electric field force of the voltage between the first suspending beam 104*a* and the second suspending beam 106*a* is smaller than the deforming force threshold of the first suspending beam 104*a*, the first suspending beam module 101*a* has an inherent pulling stress force to make the first suspending beam 104*a* rebound to the original state, thus constituting an MEMS switch member.

Figure 4:
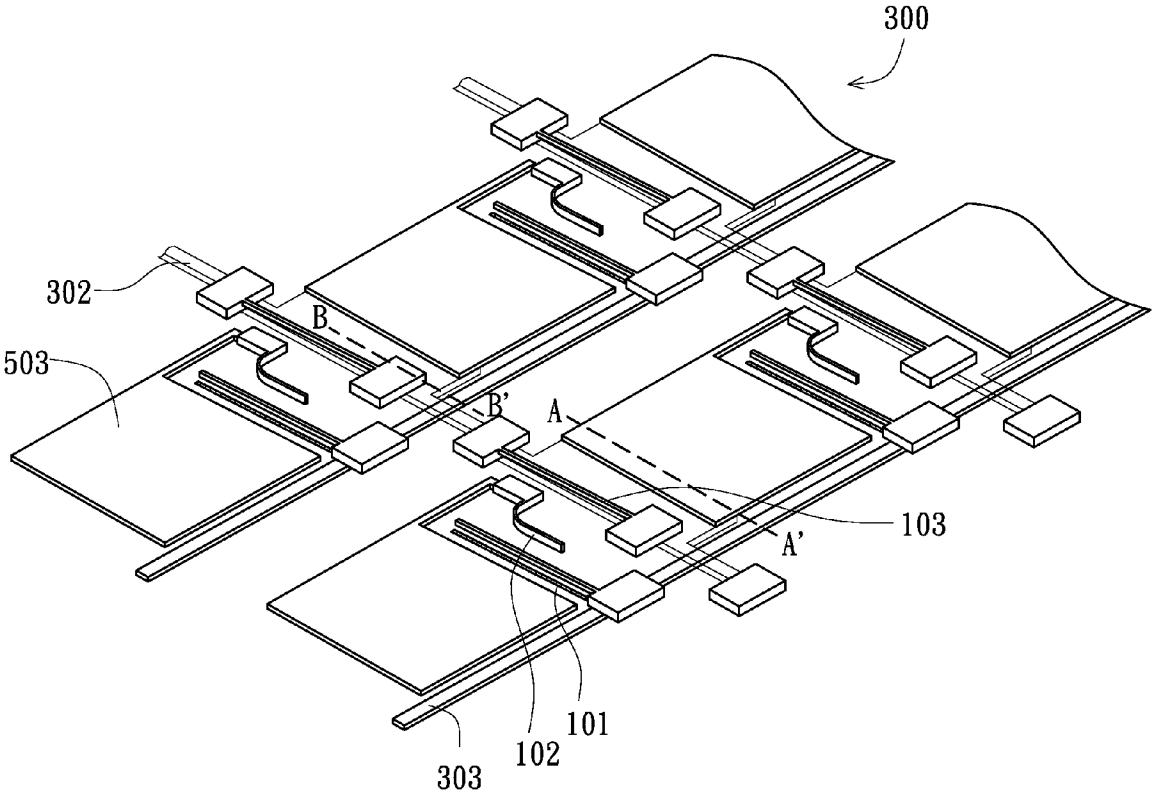
FIG. 4 shows a schematic view of a matrix array module in accordance with a preferred embodiment of the present invention.

FIG. 4 shows a matrix array module 300 formed by a plurality of the driving members 100 in the first embodiment, where each the driving member 100 corresponds to a pixel in a corresponding position on a liquid display panel (not shown). The matrix array module 300 is formed on a substrate. The substrate is made of a glass substrate or another transparent insulating substrate. The matrix array module 300 further includes a plurality of scanning line groups 302 and a plurality of signaling line groups 303. Each of the scanning line groups 302 includes a plurality of scanning lines respectively connected to the second suspending beam modules 103 of a plurality of driving members 100 in a same row. The neighboring driving members 100 are electronically connected through the substrate. Each of the signaling line groups 303 includes a plurality of signaling lines respectively connected to the first suspending beam modules 101 of a plurality of driving members 100 in a same column.

When a voltage is provided between the first suspending beam 104 and the second suspending beam 106 of the driving member 100, for example, the scanning line and signaling line connected to the driving member 100 are conducted, a voltage is formed between the first suspending beam 104 and the second suspending beam 106 of the driving member 100. Electrical signals are transmitted from the first suspending beam holding terminal 107 and the second suspending beam holding terminals 109 respectively to the first suspending beam 104 and the second suspending beam 106. Due to an electric field attractive force is larger than the deforming force threshold of the first suspending beam 104, the first suspending beam 104 moves towards the second suspending beam 106 to electrically contact with the conductive suspending beam 105, so that neighboring conductive suspending beam 105 and first suspending beam 104 are short circuited, and the neighboring conductive suspending beam 105 has a voltage same with the first suspending beam 104. When the voltage between the first suspending beam 104 and the second suspending beam 106 is 0V, or the electric field attractive force generated by the voltage is smaller than the deforming force threshold of the first suspending beam 104 (for example, it is designed that when the scanning line and the signaling line connected to the driving member 100 are not conducted, the scanning line and the signalling line have a same voltage or a voltage therebetween is smaller than a predetermined value), the electric field attractive force between the first suspending beam 104 and the second suspending beam 106 is decreased, thus the first suspending beam module 101 has an inherent pulling stress force to make the first suspending beam 104 rebound to the original state. Accordingly, the action of a pixel arranged in the corresponding position is controlled according to on and off states of the scanning line and the signal line connected to the driving member 100.

It should be understood that, the matrix array module 300 can also be formed by a plurality of the driving members 100*a* arranged in array instead. A function of the driving member 100*a* can be implemented with a repulsion force between the first suspending beam 104 and the second suspending beam 106.

Figure 5A:
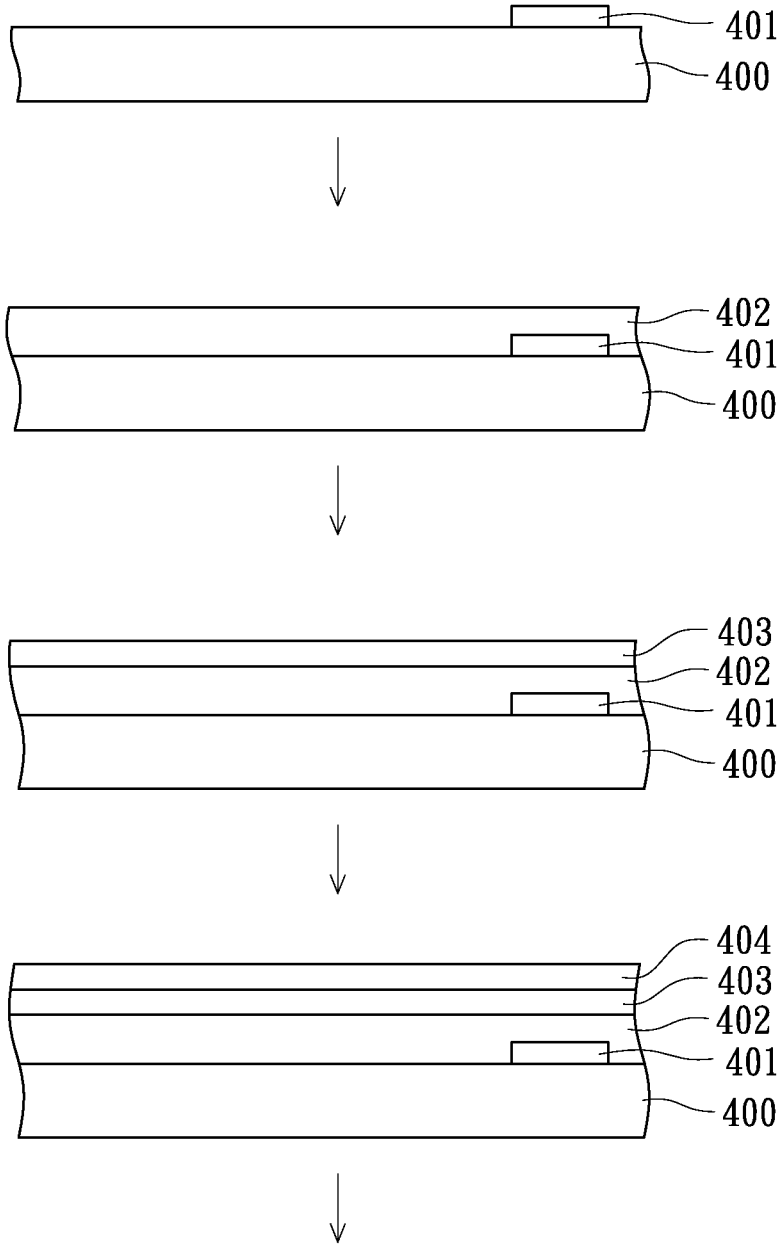
FIGS. 5A~5B show a layers manufacture process taken along the broken line BB' in FIG. 4.
Figure 5B:
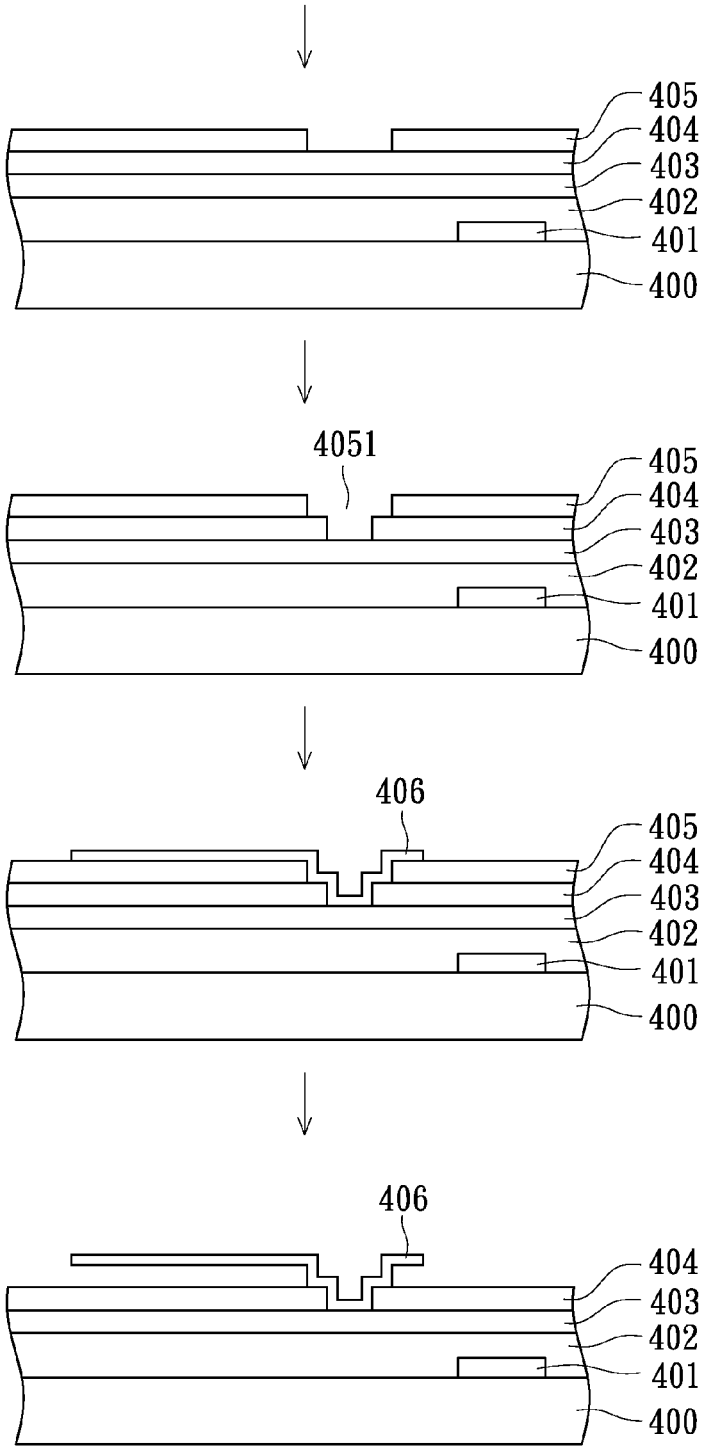

FIGS. 5A~5B show a layers manufacture process taken along the broken line BB' in FIG. 4. Firstly, plating a first metal layer (not shown) on a glass substrate 400, a first metal layer pattern 401 is formed after a photolithography etch process. The first metal layer can be made by any conductive metal or alloy, such as silver (Ag), chromium (Cr), molybdenum-chromium alloy (MoCr), aluminum-neodymium (AlNd) alloy, nickel-boron (NiB) alloy, and so on. Secondly, a first insulating layer 402 is formed on the first metal layer pattern 401. The first insulating layer 402 can be made of silicon dioxide (SiO2), silicon nitride (SiNx), and so on. Then, plating a second metal layer (not shown) on the first insulating layer 402, a second metal layer pattern 403 is formed after a photolithography etch process. The second metal layer can be made of any conductive metal or alloy, such as silver (Ag), chromium (Cr), molybdenum-chromium alloy (MoCr), aluminum-neodymium (AlNd) alloy, nickel-boron (NiB) alloy, and so on. A second insulating layer 404 is formed on the second metal layer FIG. 403. The second insulating layer 404 can be made of SiO2, SiNx, and so on. In the embodiment, a sacrifice layer 405 is further formed after the second insulating layer 404 is formed. The sacrifice layer 405 can be made of molybdenum (Mo), polymer, and so on. After that, a contacting hole 4051 is defined in the sacrifice layer 405 and the second insulating layer 404, and a suspending beam pattern 406 is formed on the sacrifice layer 405. The suspending beam pattern 406 can be made of a-Si or any conductive metal or alloy, and so on. The suspending beam pattern 406 is conducted with the second metal layer pattern 403 through the contacting hole 4051. Lastly, the sacrifice layer 405 is released/removed. Thus, an MEMS switch member is formed. The whole manufacture process is implemented by six photo-lithography masks.

Figure 6A:
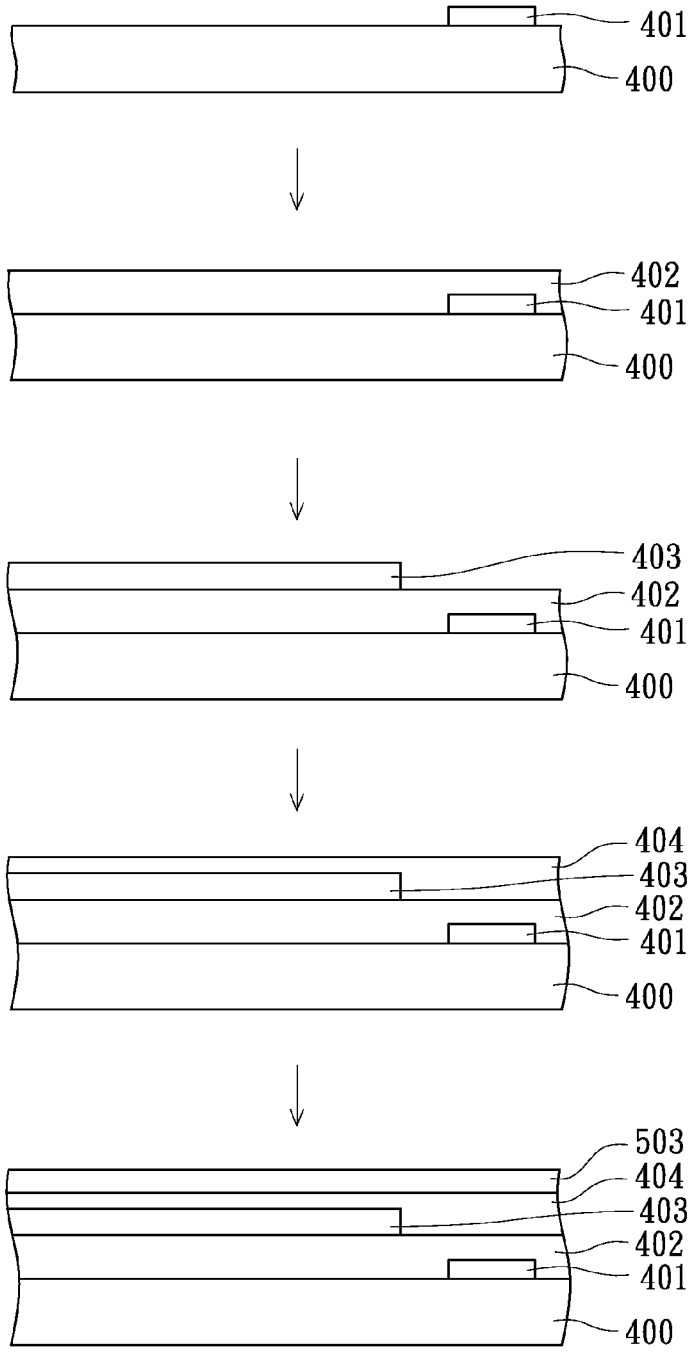
FIGS. 6A~6B show another layers manufacture process taken along the broken line AA' in FIG. 4.
Figure 6B:
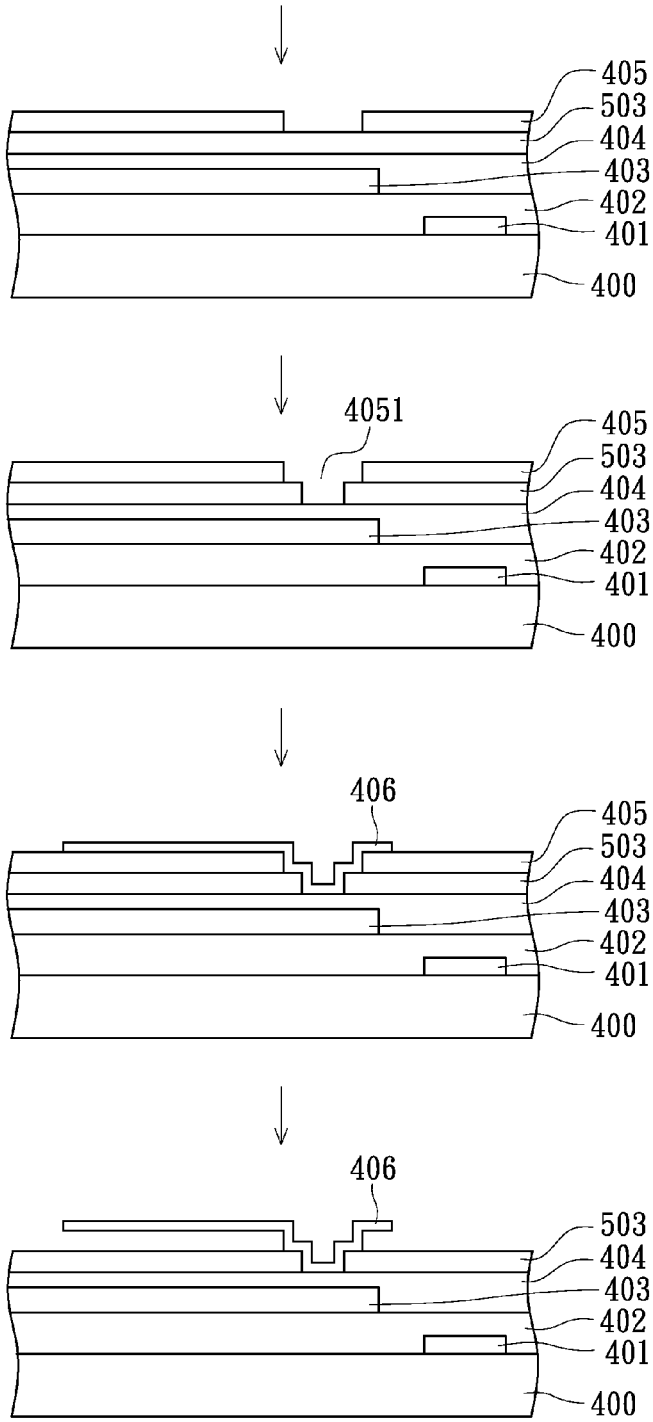

FIGS. 6A~6B show another layers manufacture process taken along the broken line AA' in FIG. 4. Based on FIGS. 5A~5B, in FIGS. 6A~6B, a conductive transparent layer 503 is further formed on the second insulating layer 404. Firstly, plating a first metal layer (not shown) on the glass substrate 400, a first metal layer pattern 401 is formed after a photolithography etch process. The first metal layer can be made of any conductive metal or alloy, such as silver (Ag), chromium (Cr), molybdenum-chromium alloy (MoCr), aluminum-neodymium (AlNd) alloy, nickel-boron (NiB) alloy, and so on. Secondly, a first insulating layer 402 is formed on the first metal layer pattern 401. The first insulating layer 402 can be made of SiO2, SiNx, and so on. Then, plating a second metal layer (not shown) on the first insulating layer 402, a second metal layer pattern 403 is formed after a photolithography etch process. The second metal layer can be made of any conductive metal or alloy, such as silver (Ag), chromium (Cr), molybdenum-chromium alloy (MoCr), aluminum-neodymium (AlNd) alloy, nickel-boron (NiB) alloy, and so on. A second insulating layer 404 is formed on the second metal layer pattern 403. The second insulating layer 404 can be made of SiO2, SiNx, and so on. The conductive transparent layer 503 is formed on the second insulating layer 404. The conductive transparent layer 503 can be made of one of tin doped indium oxide (ITO), indium zinc Oxide (IZO) and ZnO. After that, a sacrifice layer 405 is further formed on the conductive transparent layer 503. The sacrifice layer 405 can be made of molybdenum (Mo), polymer, and so on. Then, a contacting hole 4051 is defined in the sacrifice layer 405 and the conductive transparent layer 503, and a suspending beam pattern 406 is formed on the sacrifice layer 405. The suspending beam pattern 406 can be made of a-Si or any conductive metal or alloy, and so on. The suspending beam pattern 406 is conducted with the conductive transparent layer 503 through the contacting hole 4051. Lastly, the sacrifice layer 405 is released/removed. Thus, an MEMS switch member is formed.

It should be understood that, the driving member 100 and the matrix array module 300 in present invention can be used as a switch(es) for all kinds of display devices, such as electrophoretic display devices, liquid crystal display (LCD) devices, liquid powder display (LPD) devices, electroweting display (EWD) devices, Cholesteric LCD (Ch-LCD) devices, organic light-emitting display devices, light-emitting display devices, MEMS display devices, and so on.

As stated above, the driving member 100 and the matrix array module 300 provided in the present invention integrate the design of active driving member with the theory of micro-electro-mechanical system (MEMS), due to it is unnecessary to use silicon as semiconductor layer, thus the driving member 100 and the matrix array 300 have many advantages over the a-Si TFT, such as high carrier mobility supporting a faster processing system e.g. for image processing, and without the issue of leakage current that can provide a higher current switch ratio. The driving member manufacture method is implemented at a low temperature process, so as to have advantages of avoiding problems in manufacture, simplifying the process, reducing the cost, and improving the production capacity. With the advantages, the driving member 100 in present invention has more competitive strength to be the driving member of next generation.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A driving member comprising:

a first suspending beam module;

a second suspending beam module; and a conductive suspending beam module;

wherein when a voltage is provided between the first suspending beam module and the second suspending beam module, or the first suspending beam module and the second suspending beam module are provided with two homopolar voltages, and thereby when an electric field force between the first suspending beam module and the second suspending beam module is larger than a deforming force threshold of the first suspending beam module, the first suspending beam module moves to electrically contact with the conductive suspending beam module, so that the conductive suspending beam module has a voltage same with the first suspending beam module;

thereafter when the electric field force is smaller than the deforming force threshold of the first suspending beam module, the first suspending beam module rebounds to an original state;

wherein the first suspending beam module comprises a first suspending beam and a first suspending beam holding terminal, the first suspending beam holding terminal being arranged at one end of the first suspending beam, and the first suspending beam holding terminal being wider than the first suspending beam;

wherein the conductive suspending beam module comprises a conductive suspending beam and a conductive suspending beam holding terminal, the conductive suspending beam being extended from the conductive suspending beam holding terminal, and one end of the conductive suspending beam being bended towards the first suspending beam.

2. The driving member as claimed in claim 1, wherein the first suspending beam module and the second suspending beam module each is made of amorphous silicon, or any conductive metal or alloy.

3. The driving member as claimed in claim 1, wherein the second suspending beam module comprises a second suspending beam and second suspending beam holding terminals arranged at both ends of the second suspending beam, the second suspending beam holding terminals each being wider than the second suspending beam.

4. The driving member as claimed in claim 3, wherein the first suspending beam, the conductive suspending beam and the second suspending beam are all suspended in the original state.

5. The driving member as claimed in claim 3, wherein the conductive suspending beam module is arranged between the first suspending beam module and the second suspending beam module, when the voltage is provided between the first suspending bean and the second suspending beam, the first suspending beam moves towards the second suspending beam and thereby electrically contacts with the conductive suspending beam.

6. The driving member as claimed in claim 3, wherein the first suspending beam module is arranged between the conductive suspending beam module and the second suspending beam module, when the first suspending beam module and the second suspending beam module are provided with the two homopolar voltages, the first suspending beam moves away from the second suspending beam and thereby electrically contacts with the conductive suspending beam.

7. A driving member comprising:

a first suspending beam module;

a second suspending beam module; and a conductive suspending beam module arranged between the first and second suspending beam module;

wherein when a voltage applied between the first suspending beam module and the second suspending beam module is smaller than a predetermined value, the first suspending beam module is not electrically contacted with the conductive suspending beam module; when the voltage achieves the predetermined value, the first suspending beam module is electrically contacted with the conductive suspending beam module, so that the conductive suspending beam module has a voltage same with the first suspending beam module;

wherein the first suspending beam module comprises a first suspending beam and a first suspending beam holding terminal, the first suspending beam holding terminal being arranged at one end of the first suspending beam, and the first suspending beam holding terminal being wider than the first suspending beam;

wherein the conductive suspending beam module comprises a conductive suspending beam and a conductive suspending beam holding terminal, the conductive suspending beam being extended from the conductive suspending beam holding terminal, and one end of the conductive suspending beam being bended towards the first suspending beam.

8. The driving member as claimed in claim 7, wherein the first suspending beam module and the second suspending beam module each is made of amorphous silicon, or any conductive metal or alloy.

9. The driving member as claimed in claim 7, wherein the second suspending beam module comprises a second suspending beam and second suspending beam holding terminals arranged at both ends of the second suspending beam, the second suspending beam holding terminal being wider than the second suspending beam.

10. The driving member as claimed in claim 9, wherein the first suspending beam, the conductive suspending beam and the second suspending beam are all suspended in an original state.

11. A driving member array module comprising:

a substrate;

a plurality of driving members formed on the substrate;

at least a scanning line group formed on the substrate; and at least a signaling line group formed on the substrate, wherein the at least a scanning line group and the at least a signaling line group are electronically connected to the plurality of driving members;

wherein each of the plurality of driving members is the driving member as claimed in claim 1;

wherein each of the at least a scanning line group comprises a plurality of scanning lines respectively connected to the second suspending beam modules of the driving members in a same row.

12. The driving member array module as claimed in claim 11, wherein the substrate is a glass substrate or another insulating substrate.

13. The driving member array module as claimed in claim 11, wherein each of the at least a signaling line group comprises a plurality of signaling lines respectively connected to the first suspending beam modules of the driving members in a same column.

14. The matrix array module as claimed in claim 11, when the scanning line and the signaling line connected to one of the driving members are conducted, a voltage is formed between the first suspending beam and the second suspending beam of the driving member, or the first suspending beam and the second suspending beam are provided with two homopolar voltages.

15. A pixel structure, adapted to a display device and comprising:

a first suspending beam module;

a second suspending beam module; and a conductive suspending beam module;

wherein the first suspending beam module is electrically contactable with the conductive suspending beam module after being driven by an electric field force formed between the first suspending beam module and the second suspending beam module;

wherein the first suspending beam module comprises a first suspending beam and a first suspending beam holding terminal, the first suspending beam holding terminal being arranged at one end of the first suspending beam, and the first suspending beam holding terminal being wider than the first suspending beam;

wherein the conductive suspending beam module comprises a conductive suspending beam and a conductive suspending beam holding terminal, the conductive suspending beam being extended from the conductive suspending beam holding terminal, and one end of the conductive suspending beam being bended towards the first suspending beam.

16. The pixel structure as claimed in claim 15, further comprising a conductive transparent layer electrically connected to the conductive suspending beam module.

17. The pixel structure as claimed in claim 15, wherein the conductive suspending beam module is arranged between the first suspending beam module and the second suspending beam module, and the electric field force is an attractive force.

18. A driving member array module comprising:

a substrate;

a plurality of driving members formed on the substrate;

at least a scanning line group formed on the substrate; and at least a signaling line group formed on the substrate, wherein the at least a scanning line group and the at least a signaling line group are electronically connected to the plurality of driving members;

wherein each of the plurality of driving members is the driving member as claimed in claim 1;

wherein each of the at least a signaling line group comprises a plurality of signaling lines respectively connected to the first suspending beam modules of the driving members in a same column.

* * * * *